United States Patent [19]

Bühler

[11] 3,960,185

[45] June 1, 1976

[54] RIBBON WEAVING LOOM CONSTRUCTION

[75] Inventor: Erich Bühler, Eichsel, Germany

[73] Assignee: Jacob Müller, Frick, Switzerland

[22] Filed: Dec. 11, 1973

[21] Appl. No.: 422,941

[30] Foreign Application Priority Data

Dec. 11, 1972 Switzerland ..... 17988/72

[52] U.S. Cl. ..... 139/307; 139/22

[51] Int. Cl.[2] ..... D03D 49/20; D03D 35/00

[58] Field of Search ..... 139/304, 307, 308, 22, 139/23, 291 R, 29 R

[56] References Cited

UNITED STATES PATENTS

| | | | |
|---|---|---|---|
| 398,365 | 2/1889 | Wyman | 139/308 |
| 639,626 | 12/1899 | Steere | 139/22 |
| 876,407 | 1/1908 | Steele | 139/307 |
| 917,435 | 4/1909 | Holmes et al. | 139/22 |
| 1,599,545 | 2/1926 | Arnold et al. | 139/23 |
| 2,771,098 | 11/1956 | Ross | 139/307 X |
| 2,833,316 | 5/1958 | Brown | 139/307 |
| 3,200,852 | 8/1965 | Koyder | 139/304 |
| 3,727,648 | 4/1973 | Essig | 139/291 R |

FOREIGN PATENTS OR APPLICATIONS

| | | | |
|---|---|---|---|
| 455,940 | 6/1913 | France | 139/307 |
| 2,223 | 1861 | United Kingdom | 139/22 |
| 3,786 | 1873 | United Kingdom | 139/291 R |

*Primary Examiner*—James Kee Chi

*Attorney, Agent, or Firm*—Michael J. Striker

[57] ABSTRACT

In a ribbon-weaving loom, in which at least two ribbons are being woven simultaneously and must be withdrawn in substantial parallelism, at least one withdrawing roller is provided for each of these ribbons and so located that the respective ribbon is trained about it with the roller being located beneath the ribbon. A drive arrangement is provided for driving the respective rollers.

9 Claims, 5 Drawing Figures

Fig 1
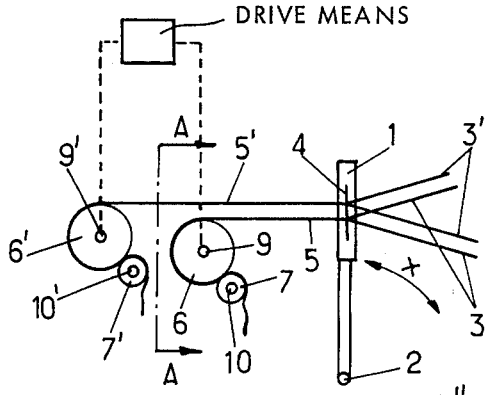
Fig. 2
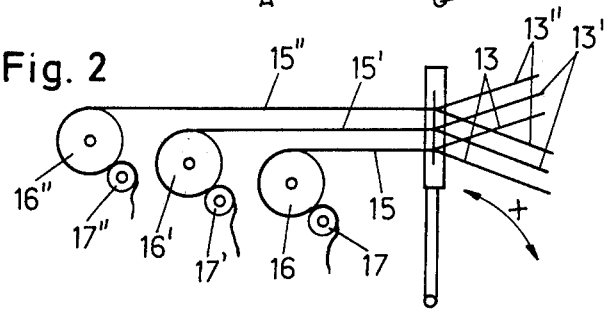
Fig. 3
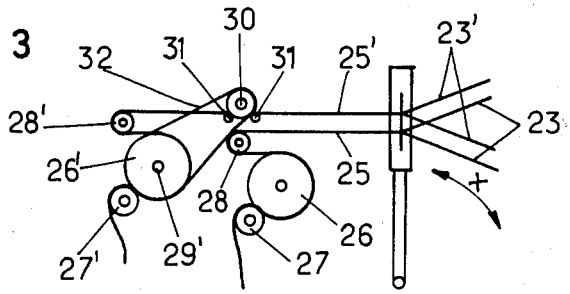
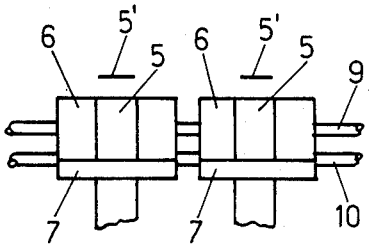
Fig. 4
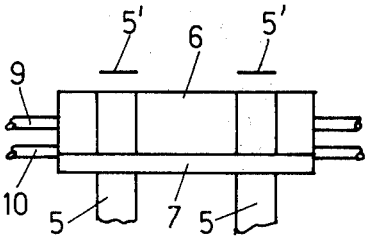
Fig. 5

RIBBON WEAVING LOOM CONSTRUCTION

BACKGROUND OF THE INVENTION

The present invention relates to a ribbon-weaving loom construction, and more particularly to a ribbon-weaving loom construction wherein two or more ribbons are being woven simultaneously and must be withdrawn in substantial parallelism.

In circumstances where a single ribbon is being woven on a loom, the withdrawal of the woven ribbon presents no difficulty because the ribbon is withdrawn over a breast beam or a roller or a shaft replacing the breast beam in downward direction, and is then engaged by a withdrawing roller cooperating with a counterpressure roller. Each ribbon is associated with a separate withdrawing arrangement, or else two or more ribbons (located laterally adjacent one another) can be withdrawn by a single withdrawing arrangement.

However, there are ribbon weaving looms where two or more ribbons are being woven simultaneously and are so located relative to one another that they must be withdrawn in parallelism. If under these circumstances the ribbons are supplied in overlying relationship to the breast beam or the roller replacing it, various disadvantages are experienced. The outermost ribbon of the overlying ones particularly if the ribbons are relatively thick, will be withdrawn more rapidly than the innermost ribbon because the thickness of the ribbon becomes added to the diameter of the withdrawing roller and thus the radius of the withdrawing roller is in effect increased by the thickness of the innermost ribbon, which explains why the outermost ribbon will be withdrawn faster.

An additional drawback is the fact that the outermost ribbon is not in contact with the withdrawing roller, which is usually provided with a friction-promoting coating or surface, since the innermost ribbon is interposed between the withdrawing roller and the outermost ribbon. This means that slippage of the outermost ribbon with reference to innermost ribbon can occur, especially if the ribbons are of relatively smooth or slippery material. This, in turn, can result in qualitative problems.

The prior art has recognized these difficulties and has proposed to supply ribbons which issue from the loom in parallelism and substantially overlying relationship, to the breast beam or the withdrawing arrangement in a slightly converging manner so that they will contact the breast beam or the withdrawing roller not in overlying relationship but in side-by-side relationship. This does avoid the disadvantages which have been outlined above, but it brings with it a new problem, namely the ribbons will become laterally stretched so that they are no longer straight in that the material of the ribbons is stretched more along one lateral side than the other.

SUMMARY OF THE INVENTION

Accordingly, it is a general object of the present invention to overcome the disadvantages of the prior art.

More particularly, it is an object of the present invention to provide a ribbon-weaving loom construction of the type wherein at least two ribbons are being woven simultaneously and must be withdrawn in substantial parallelism, which avoids these disadvantages.

Still more particularly, the invention aims to provide such a ribbon-weaving loom construction which assures a completely uniform and even withdrawal of the ribbons.

In keeping with these objects and with others which will become apparent hereafter, one feature of the invention resides in a ribbon-weaving loom, in which at least two ribbons are being woven simultaneously and must be withdrawn in substantial parallelism. In this construction, the invention provides a combination which comprises at least one withdrawing roller for each of the ribbons and about which the respective ribbon is trained so that the roller is located beneath the ribbon, and means for rotating the respective rollers. It is advantageous that the rollers all are of identical diameter, that they be jointly driven so that the rate of withdrawal for all of the overlying ribbons is exactly uniform. Of course, if several ribbons are located laterally adjacent one another and in effect form one layer of ribbons, and another layer or additional layers overlie the first layer, then the rollers for each layer can of course be mounted on a common shaft or they can be of one piece with one another. Each roller can be associated with a breast beam or with a ribbon reversing roller and with a pressure roller.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a diagrammatic side view illustrating one embodiment of the present invention, for two overlying ribbons and without the use of breast beams;

FIG. 2 is a view similar to FIG. 1 but illustrating an arrangement for three overlying ribbons;

FIG. 3 is a view similar to FIG. 1 but illustrating a different embodiment using breast beams and a distance roller or spacing roller for the upper ribbon;

FIG. 4 is a vertical section on line A—A of FIG. 1 but illustrating a somewhat modified embodiment; and FIG. 5 is a view similar to FIG. 4 but illustrating still another modified embodiment.

DESCRIPTION OF THE PREFERRED EMBODIMENTS

I wish it to be understood that the drawings show the various embodiments in diagrammatic illustrations. It is believed that this is entirely sufficient for persons of ordinary skill in the art to understand and be able to practice the invention, inasmuch as the construction and operations of ribbon-weaving looms per se is conventional and well-known to those having skill in this art.

With the above comments in mind and referring firstly to FIG. 1, it will be seen that reference numeral 1 identifies a sley which pivots about the axis 2 as indicated by the double-headed arrow X. Two overlying warps 3, 3' are provided into which needles or shuttles insert the weft thread in a manner not illustrated because it is entirely conventional. The thread is beaten up by the reed 4. This results in the production of two ribbons 5, 5' of which the ribbon 5 is located above the ribbon 5'.

The lower one of these ribbons, namely the ribbon 5, is directly trained about a withdrawing roller 6 against which it is pressed by the counterpressure roller 7, to subsequently descend under the influence of gravity into a non-illustrated bin or the like. The upper ribbon 5' is trained about a withdrawing roller 6' against which it is pressed by a counterpressure roller 7' to also descend downwardly. The rollers, 7, 7' are rotatable about axes 10, 10', respectively, and the rollers 6, 6' are rotatable about axes 9, 9', respectively.

The embodiment in FIG. 2 is substantially the same as in FIG. 1, except that here three warps 13, 13', and 13'' are provided. The operation of the sley and the reed is the same as before, and in this embodiment three ribbons 15, 15' and 15'' are being produced. The lower ribbon 15' is trained about and withdrawn via the withdrawing roller 16 which cooperates with a counterpressure roller 17, the intermediate ribbon 15' is trained about and withdrawn by the roller 16' which cooperates with a counterpressure roller 17', and the upper ribbon 15'' is trained about and withdrawn by withdrawing roller 15'' which cooperates with counterpressure roller 17''.

FIG. 3 shows an embodiment in which, as in the case of FIG. 1, two warps 23, 23' are provided from which two ribbons 25, 25' are produced in the same manner as in FIG. 1. In FIG. 3, however, the ribbons 25, 25' are each deflected around a breast beam 28, 28', which in the illustrated embodiment is configurated as a deflecting or reversing roller. Subsequently, the ribbons 25, 25' pass onto the withdrawing rollers 26, 26' which cooperate with the counterpressure rollers 27, 27'.

In addition, the embodiment of FIG. 3 provides for the upper ribbon 25' a distancing or spacing roller 30 which is spaced from the beating-up location by the same distance as is the breast beam 28. The roller 30 cooperates with two counterrollers 31, and is driven in rotation by the roller 26' or the shaft 29' of the latter, via a drive belt 32 or the like. This particular measure has been found to be of advantage if the ribbons 25, 25' are of such nature as to exhibit a certain elasticity, because this can mean that the degree to which the ribbons 25, 25' can stretch would be of differential magnitude. This, in turn, would mean that the density of the weave would differ in the two ribbons. The problem is avoided by the use of the spacing roller 30, which incidentally an also be used in the embodiment of FIG. 1; in the latter case the spacing roller would have to be spaced from the beating-up location by the same distance as is the roller 6.

FIG. 4 shows that two or more ribbons can be located laterally adjacent one another. Thus, in the embodiment of FIG. 4 it is shown that several of the ribbons 5 are located laterally adjacent one another, and of course another layer (only diagrammatically illustrated) is represented by the overlying ribbons 5'. In such an arrangement the withdrawing rollers associated with the respective layer of ribbons can be mounted on a common shaft being laterally adjacent one another. In FIG. 4 this has been shown by illustrating two withdrawing rollers 6, and their associated counterpressure rollers 7, with the withdrawing rollers 6 being mounted on a common shaft 9, and the rollers 7 on a common shaft 10. The same would be true of the rollers 6' and 7' which have not been illustrated in FIG. 4.

FIG. 5, finally, shows still another embodiment analogous to that of FIG. 4, but indicating that instead of providing separate rollers 6, and 7 for the individual ribbons of a layer, the rollers 6 for the various ribbons of the layer and the associated rollers 7, can be made of one-piece with one another. Only the rollers 6 and 7 are shown for ribbons 5, although it should be understood that similar rollers 6' and 7' will be provided for the diagrammatically illustrated layer of ribbons 5'.

With the present invention it is possible to withdraw two or more ribbons entirely uniformly and to avoid, in particular, an irregular density of the weave. Moreover, with the arrangement of the present invention access to the loom from the front and viewing of the loom is in no way subject to interference. Since, there is no lateral shifting of the ribbons as they are being withdrawn, but instead, all ribbons are being withdrawn in a perfectly straight line from the loom to the respective withdrawing roller, there is no possibility that the ribbons might become twisted or unevenly pulled and thus damaged or at least reduced in quality.

It will be understood that each of the elements described above, or two or more together, may also find a useful application in other types of constructions differing from the types described above.

While the invention has been illustrated and described as embodied in a ribbon-weaving loom withdrawing arrangement, it is not intended to be limited to the details shown since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention and therefore, such adaptations should and are intended to be comprehended within the meaning and range of equivalence of the following claims.

What is claimed as new and desired to be protected by Letters Patent is set forth in the appended claims:

1. In a ribbon-weaving loom, in which at least two ribbons are being woven simultaneously and from which the ribbons must be withdrawn in substantial parallelism, a combination comprising at least one withdrawing roller for each of said ribbons, and about which the respective ribbon is trained so that the roller is located beneath the ribbon, one of said withdrawing rollers being located at a level lower than the other withdrawing roller; a spacing roller for the ribbon on said other withdrawing roller, said spacing roller being located at a level above said one withdrawing roller; drive means for rotating the respective withdrawing rollers; and means for driving said spacing roller in rotation so that the density of weave of both of said ribbons is substantially identical.

2. A combination as defined in claim 1, wherein said withdrawing rollers have identical diameters.

3. A combination as defined in claim 1; and further comprising at least one pressure roller and one breast beam associated with each of said withdrawing rollers.

4. A combination as defined in claim 1; and further comprising a breast beam associated with each of said withdrawing rollers.

5. A combination as defined in claim 1, wherein said drive means for driving said spacing roller with the same peripheral speed as said other withdrawing roller.

6. A combination as defined in claim 1, wherein said spacing roller transports said ribbon on said other withdrawing roller; and further comprising at least one counterpressure roller cooperating with said spacing roller.

7. A combination as defined in claim 1, wherein said loom weaves additional ribbons each of which is located laterally adjacent of and in the same plane as one of the first-mentioned ribbons, said withdrawing rollers comprising additional withdrawing rollers, one for each additional ribbon; and wherein the withdrawing rollers for ribbons located in the same plane are mounted on a common shaft.

8. A combination as defined in claim 1, wherein said loom weaves additional ribbons of which each is located laterally adjacent of and in the same plane as one of the first-mentioned ribbons, said withdrawing rollers comprising additional withdrawing rollers, one for each additional ribbon; and wherein the withdrawing rollers for ribbons located in the same plane are of one piece with one another.

9. In a ribbon-weaving loom, in which at least two ribbons are being woven simultaneously and from which the ribbons must be withdrawn in substantial parallelism, a combination comprising at least one withdrawing roller for each of said ribbons, and about which the respective ribbon is trained so that the roller is located beneath the ribbon, one of said withdrawing rollers being located at a level lower than the other withdrawing roller; a spacing roller for the ribbon on said other withdrawing roller, said spacing roller being located at a level above said one withdrawing roller and transporting said ribbon on said other withdrawing roller; at least one counterpressure roller cooperating with said spacing roller; drive means for rotating the respective with drawing rollers; and means for driving said spacing roller in rotation with the same peripheral speed as at least one of said withdrawing rollers.

* * * * *